US008079596B1

(12) United States Patent
Shoemaker, Jr.

(10) Patent No.: US 8,079,596 B1
(45) Date of Patent: Dec. 20, 2011

(54) REDEMPTION GAME WITH SECURITY MEASURE

(76) Inventor: Stephen P. Shoemaker, Jr., Redondo Beach, CA (US)

( * ) Notice: Subject to any disclaimer, the term of this patent is extended or adjusted under 35 U.S.C. 154(b) by 0 days.

(21) Appl. No.: 12/903,722

(22) Filed: Oct. 13, 2010

(51) Int. Cl.
*A63F 7/36* (2006.01)
*A63F 9/00* (2006.01)

(52) U.S. Cl. ..... 273/447; 273/448

(58) Field of Classification Search ..... 273/440, 273/447, 448
See application file for complete search history.

(56) References Cited

U.S. PATENT DOCUMENTS

| | | | | |
|---|---|---|---|---|
| 6,770,001 | B1 * | 8/2004 | Shoemaker, Jr. | 473/447 |
| 6,957,813 | B2 * | 10/2005 | Verstraeten | 273/448 |
| 7,594,662 | B2 * | 9/2009 | Fukazawa et al. | 273/447 |
| 7,604,238 | B2 * | 10/2009 | Verstraeten | 273/448 |
| 7,635,131 | B2 * | 12/2009 | Fukazawa et al. | 273/447 |
| 7,857,318 | B1 * | 12/2010 | Shoemaker et al. | 273/448 |
| 2003/0090065 | A1 * | 5/2003 | Carter et al. | 273/447 |
| 2007/0018407 | A1 * | 1/2007 | Shoemaker | 273/356 |
| 2007/0029734 | A1 * | 2/2007 | Fukazawa et al. | 273/447 |
| 2009/0191931 | A1 * | 7/2009 | Peck | 463/7 |
| 2010/0090408 | A1 * | 4/2010 | Fukazawa et al. | 273/447 |

FOREIGN PATENT DOCUMENTS

JP 2009189544 A * 8/2009

* cited by examiner

*Primary Examiner* — Raleigh W. Chiu
(74) *Attorney, Agent, or Firm* — Fulwider Patton LLP

(57) ABSTRACT

A redemption game is disclosed having an intermediate holding area for prizes that have been acquired by skillful or fortunate playing of the game, the holding area being inaccessible to the player. The compartment can be accessible via a pivotally mounted floor that leads to a lockable compartment. The lockable compartment would be accessible only with a key or other means that would be controlled by an attendant, so that a player could not acquire a prize without the help of the attendant. In this manner, thieves would be thwarted from cheating the game because the could not acquire the prizes without the assistance of an attendant.

10 Claims, 3 Drawing Sheets

REDEMPTION GAME WITH SECURITY MEASURE

BACKGROUND OF THE INVENTION

The present invention relates generally to arcade style amusement games of skill and gambling games of chance, and more particularly a game with a player-controlled or game-controlled crane that includes a security compartment where valuable prizes can be withdrawn only be authorized personnel.

Redemption games that measure a player's skill and luck are well known in the art. The present inventor is also the inventor and owner of many popular games found in today's' arcades. For example, U.S. Pat. No. 4,272,082, entitled "Coin Projecting Amusement Device," discloses an amusement wherein coins may be controllably deposited by the player on a playing surface having a multiplicity of surface interruption means thereon. A vertical dam translates over at least a portion of said playing surface and pushes said deposited coins against a random pattern of accumulated coins, causing some of said accumulated coins to fall over an edge into a collecting and counting means. This game is marketed and sold under the trademark "Wedges and Ledges." U.S. Pat. No. 4,303,248, also invented by the present inventor, discloses an amusement game where coins are dropped onto a flat surface over which a vertical dam is horizontally translated. The vertical dam translates over a portion of the flat surface and drops a certain of the accumulated coins over the edge. As the coins drop over the edge, they are collected in a counting chute to be synchronously counted in a memory which is then unloaded to vend out a corresponding number of tokens.

U.S. Pat. No. 4,726,585 also discloses an amusement apparatus in which a player controls a pushing device to push items off of a playing field. A moveable surface is driven in a first pre-determined path and the pusher device is moveable in a linear path traverse to the path travel of the moveable surface. A delivery passage at one end of the path of the pusher device is arranged to deliver any item swept off the surface to a retrieval bin. U.S. Pat. No. 4,822,045 is directed to an amusement device comprised of a pair of spaced apart elongate members defining a track, and a rolling member for rolling along that track under control of an operator. The elongate members are spaced a fixed distance apart at their first ends since this ends comprising since this end comprising the normal home position of the rolling member. The opposite, second ends of the elongate members are moveable relative to one another to adjust their spacing and to control the movement of the rolling member along the track. The operator controls the separation of the elongate member so that the rolling member can roll from its home position to the opposite end of the track without falling between the opening separating the elongate members.

U.S. Pat. No. 5,553,865 discloses a rotary arcade game including a turn table having a central aperture. Prizes are positioned on the surface of the turn table and moved by a pivoting arm member operated by the player. The player attempts to manipulate an arm member to push prizes into a collection pocket where they are detected and dispensed to the player. U.S. Pat. No. 5,855,374 is directed to a crane game using a vacuum to selectively pick up prizes within a bin. The prizes are arrayed on a rotating turn table, and the player manipulates a vacuum pick up device linearly along a radial direction of the turn table to pick up prizes below. U.S. Pat. No. 6,139,429 discloses another crane game using a video screen for displaying images. A maneuverable sensor contacts the display screen to select prizes displayed thereon.

U.S. Pat. No. 6,095,519 discloses an arcade game including a directing mechanism for aiming a game piece such as a token. U.S. Pat. No. 6,598,881 discloses a crane game with a prize redistribution mechanism for dispersing prizes to a substantially level configuration. Finally, U.S. Pat. No. 6,770,001 discloses a vacuum crane game with targets having beaded portions that vary the difficulty of acquiring said targets.

Games of skill or chance such as those above often use the allure of prizes to attract players. Prizes such as watches, MP4's, radios, cameras and jewelry are costly and the more desirable the prizes the more players will be drawn to the game, and the more business it will do. However, there is a drawback to using prizes that that are valuable above the usual plush animals and the like, and that is that thieves will target the games to try and steal the prizes instead of winning them. The way current redemption type crane games are arranged, when a player successfully captures a prize the crane moves the prize to a drop zone which leads to a compartment where the player can then retrieve the prize. However, if prizes are valuable, thieves can tip or shake the game in an attempt to cause prizes to tumble into the drop zone where they can be retrieved by the thieves. Therefore, there has been a reluctance on game owners to use more expensive prizes in the redemption games.

SUMMARY OF THE INVENTION

The present invention is a redemption game of chance or skill that has an intermediate holding area for prizes that have been acquired by skillful or fortunate playing of the game, the holding area being inaccessible to the player. The compartment can be accessible via a pivotally mounted floor that leads to a lockable compartment. The lockable compartment would be accessible only with a key or other means that would be controlled by an attendant, so that a player could not acquire a prize without the help of the attendant. In this manner, thieves would be thwarted from cheating the game because he could not acquire the prizes without the assistance of an attendant. This allows a much higher level of prizes that can be offered to the player, which in turn draws more attention and business to the game.

Other features and advantages of the invention will become apparent from the following detailed description, taken in conjunction with the accompanying drawings which illustrate, by way of example, the features of the invention

DETAILED DESCRIPTION OF THE PREFERRED EMBODIMENTS

For a better understanding of the present invention together with other and further objects, advantages and capabilities thereof, reference is made to the following disclosure and appended claims in connection with the above described drawing. The present invention is a new variation of crane games invented by the present inventor, including those described in U.S. Pat. Nos. 5,855,374, 6,598,881, and 6,770,001, the contents of each of which are fully incorporated herein by reference.

Figure 1:
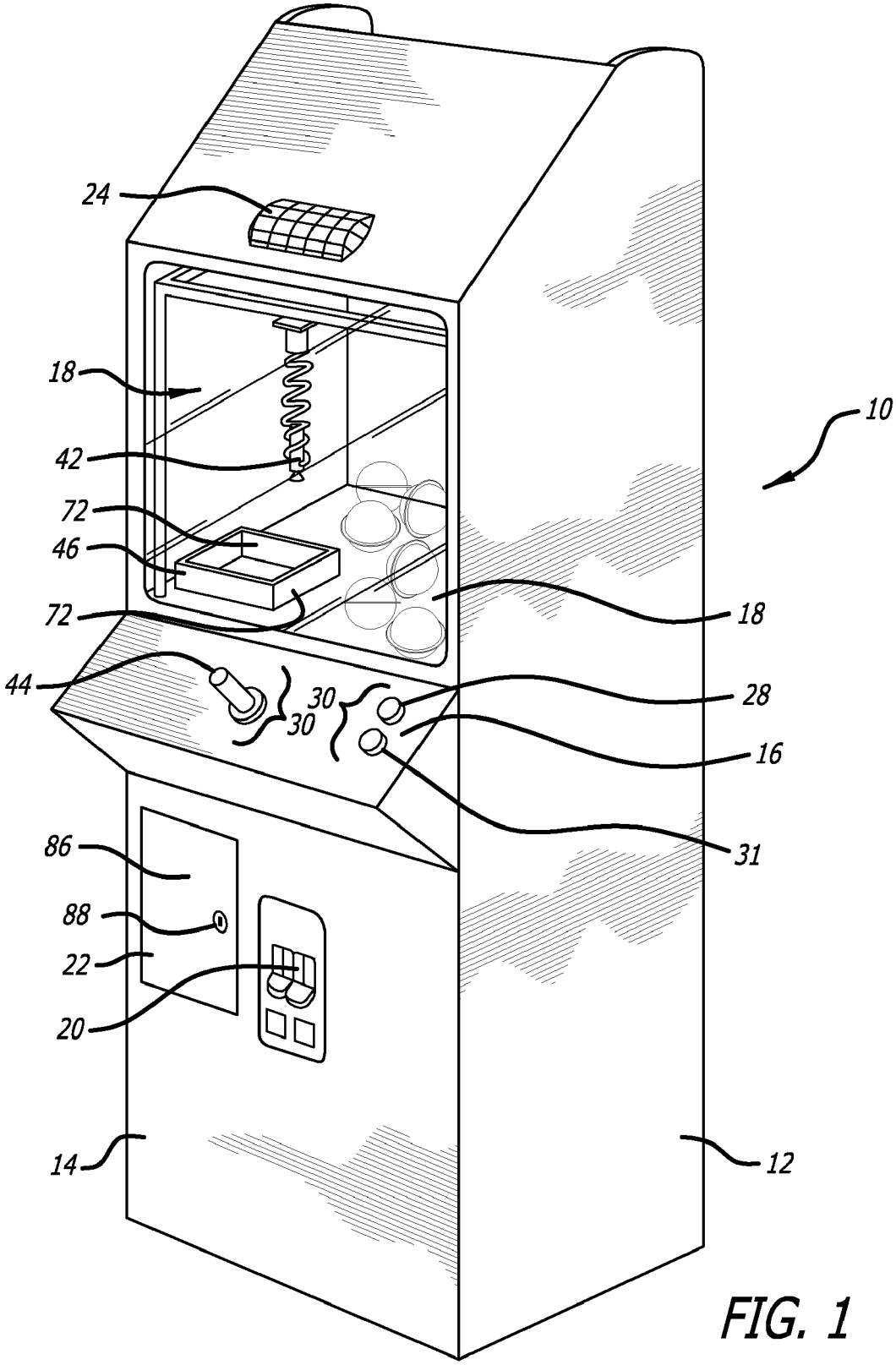
FIG. 1 is an elevated perspective view of a redemption game including a security feature of the present invention.

FIG. 1 is a perspective view of one embodiment of a game apparatus 10 in accordance with the present invention. Game apparatus 10 includes a housing 12, front panel 14, and a playing area 18. Housing 12 provides a support for the other components of the game apparatus. Housings can take a wide variety of forms; for example, as shown in FIG. 1, housing 12 may be of the stand-up REDEMPTION game variety in which a player stands in front of the game or sits on a stool when playing the game. In other embodiments, other types of housings may be provided. For example, a counter-top housing, including approximately the upper half of housing 12 shown in FIG. 1, can be used when the game apparatus is desired to be placed on a table, counter top or other similar surface.

Front panel 14 can be positioned below and/or above the player controls 30 and playing field 18, as shown in FIG. 1. The front panel can also be positioned in a wide variety of other locations on housing 12. Front panel 14 includes a coin deposit slot 20, dispenser 22, and a speaker 24 may also be provided on the housing. Coin deposit slot 20 typically accepts standard currency coins, game tokens, or bills that are often available in an arcade OR GAMING environment. In some embodiments, other types of monetary input may also be provided using a magnetic card reader to read a card with a magnetic strip that holds game credit information, or a bank card such as a credit card, debit card, etc. A coin deposited in coin deposit slot 20 (or other payment method) starts a game. Dispenser compartment 22 is used to provide prizes to players that have successfully played the game.

Speaker(s) 24 can emit sounds based on game actions and other game states and is controlled by a game control system as described subsequently. The front panel 14 can also include other features if appropriate. For example, in an alternative embodiment, a ticket dispenser (not shown) may be included on front panel 14 if desired to dispense a ticket award to the player based upon a game score, characteristics of a captured object, or other result or event of a game, rather than (or in addition to) providing the player with a prize in dispenser 22.

Player control panel 16 allows a player to manipulate events in the game, and includes an actuation device such as a push button 28 to initiate the movement of the crane. Alternatively, the motion of the crane in the two dimensional horizontal plane can be ongoing, and help attract players to the game. Game action occurs in playing area 18, where a pick up mechanism 42 is moved about the playing area 18 using a joystick 44 or other controller device. Alternatively, the movement of the pick-up device 42 can be controlled to operate randomly. In one embodiment, the player actuates the crane using the push button 28 when the crane's random motion moves over a prize desired by the player. The crane can be a claw, an electro magnet, a vacuum or other pick-up device. Once the push button 28 is pressed, the crane immediately stops moving in its random motion above the playing area and the game then lowers the pick-up device in the spot where it was when the player pressed the button 28, and if the player is accurate the crane may capture a prize and carry it to the treasure chest 46. Alternate controls can also be provided to select various game functions, such as sensitivity of the controls, number of players in a game, activate sound, etc. For example, in the described embodiment, a slow button 31 can be pressed by the player to slow down the movement of the crane during the random motion portion of the game so as to allow the player a better opportunity to acquire the selected prize. In some embodiments, a player may get multiple chances to guide the pick up mechanism with one coin or credit, or, alternatively, the player may be required to insert additional coins.

Game playing area 18 is used to display the game action and prizes to a player and is the area where game action occurs. A transparent shield can prevent the player from interfering with game action. The playing area 18 houses a prize display area and a pick-up device 42, which can be a claw type pick-up device or a vacuum pick up device as shown. The game's controller governs the motion of the pick up device above the playing field. At some point the player actuates the pick-up device via control panel 16 to stop the motion of the crane in the horizontal plane and lowers the pick-up device so that a prize may be picked up. If a prize is picked up, the game controller automatically guides the pick up head to the treasure chest 46 and releases the prize, and moves back into a starting position. However, unlike prior crane games, the player cannot retrieve the prize and it sits in the drop zone, or "treasure chest," until the game is authorized to release the prize.

Figure 2:
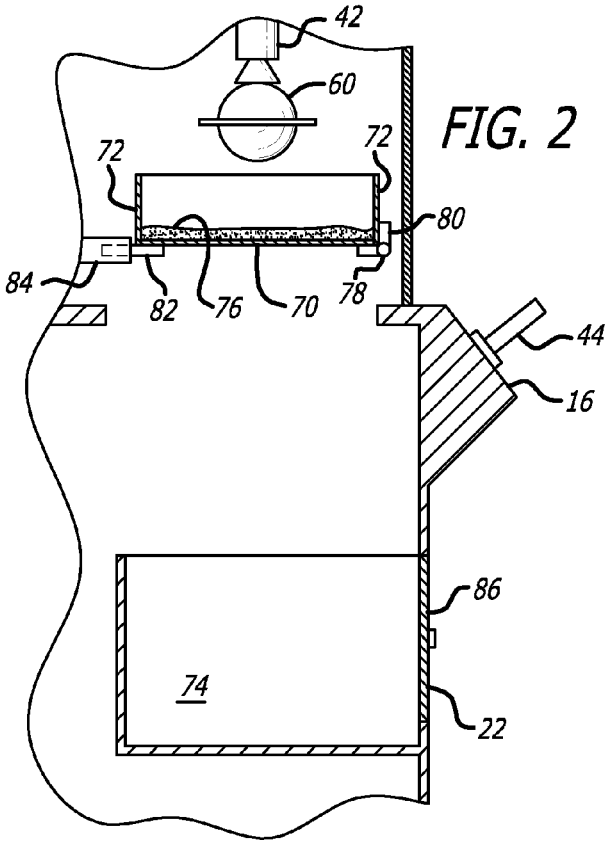
FIG. 2 is a sectional, cross-sectional view of the security feature of the embodiment of FIG. 1.
Figure 3:
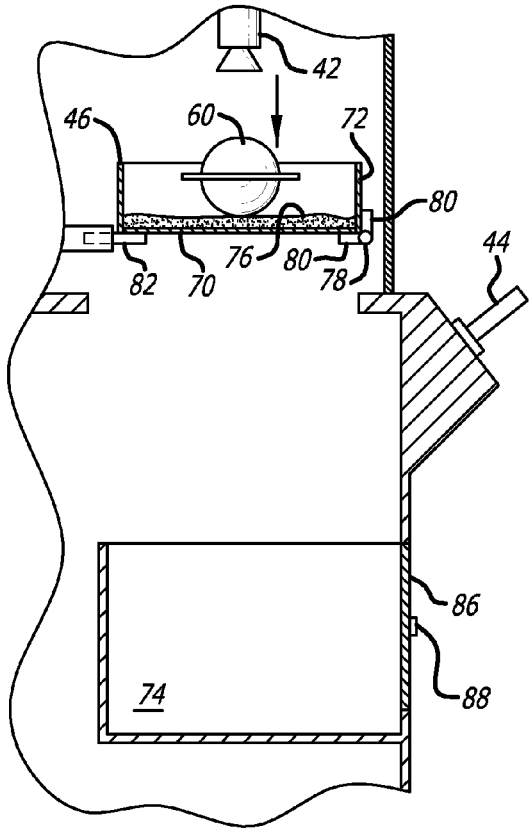
FIG. 3 is the sectional, cross-sectional view of FIG. 2 where the prize has been placed in the drop zone.

FIG. 2 illustrates the condition right before the pick-up mechanism 42 releases the prize 60. A drop zone has a box-like structure having a floor 70, and side walls 72 and an open top to allow the prize 60 to drop or be lowered therein. To cushion the prize, the drop zone may have a felt 76 or other soft material lining the drop zone so that the prize lands or is placed softly. This can be important where prizes can be broken or damaged by even slight jarring. Once hovered above the drop zone, the crane pick-up device 42 releases the prize 60 as shown in FIG. 3, allowing the prize to fall or come to rest in the drop zone, also called the "treasure chest 46."

Figure 4:
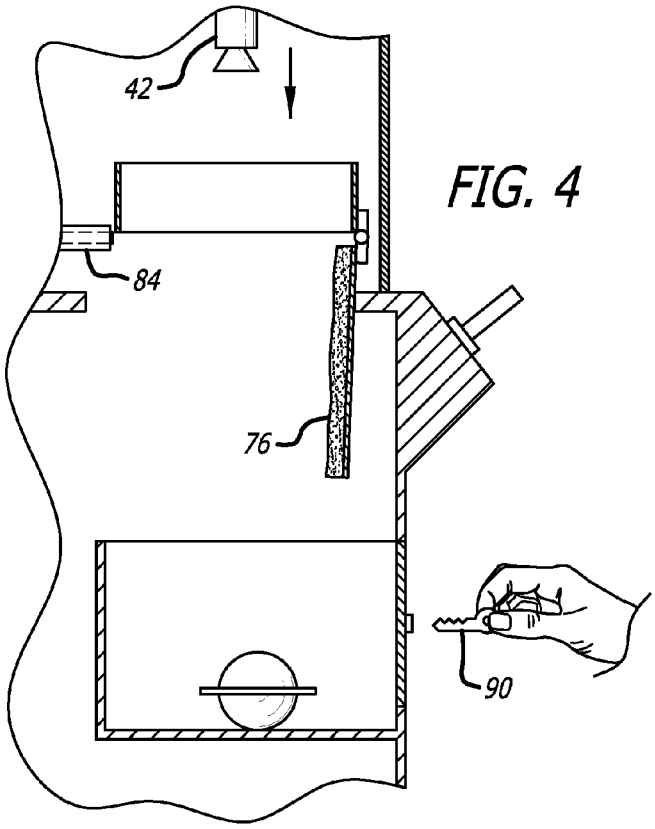
FIG. 4 is the sectional, cross-sectional view of FIG. 2 where the prize has been transferred to the security compartment.

The drop zone 46 can be pivotally mounted inside the housing by affixing a side of the drop zone to a pin 78 coupled to a bracket 80. The drop zone can thus pivot about the pin 78, from at least a horizontal position to a vertical position such as that shown in FIG. 4. As shown in FIG. 2, the drop zone 46 is held in a horizontal position by a spring loaded projection 82, which is biased outward to support the drop zone. A spring (not shown) biases the projection 82 in an extended position from a ledge 84 until it lies beneath the floor 70 of the drop zone 46, supporting the drop zone in the horizontal position as shown.

Figure 5:
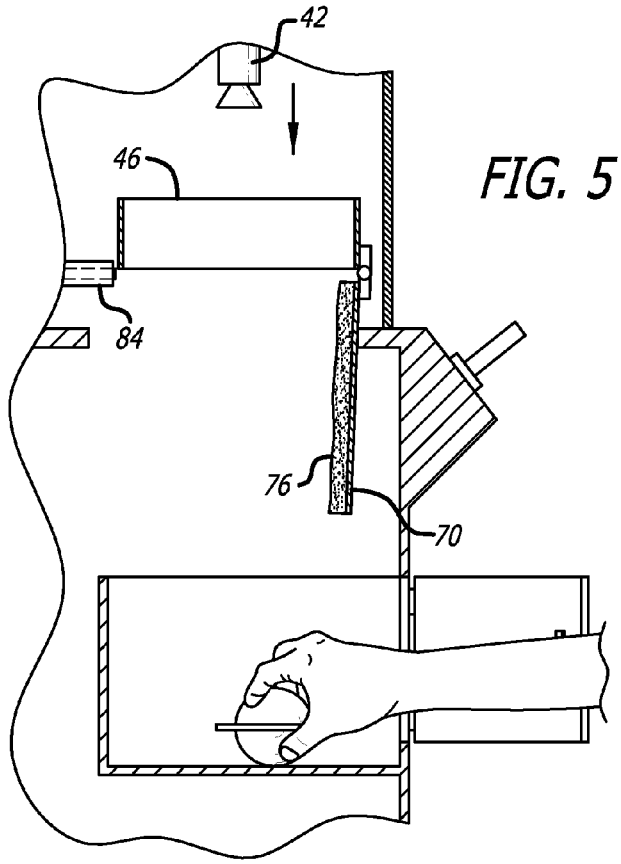
FIG. 5 is the sectional, cross-sectional view of the security feature where the prize has been extracted from the security compartment.

Below the drop zone 46 is a security compartment 74 that is accessible through a lockable door 86 with a lock 88, that can be opened with a key 90. Of course there are many ways to secure the door like combination lock or such. In this description, to acquire the prize 60, an attendant with a key 90 opens the lockable door 86 by inserting the key 90 into the lock 88 (FIG. 5), and opens the door. This can be done before the prize is dropped into the security compartment of the projection 82 can be withdrawn from outside the security compartment, such as a button or lever that withdraws the projection 82 to allow the drop zone 46 to pivot about the pin 78 and drop the prize into the security compartment 74. Alternatively, the attendant or manager unlocks the door and reaches into the compartment to manually push in the projection 82 against the biasing force of the spring, allowing the drop zone to rotate downward and the prize 60 can be retrieved from the security compartment 74.

From the foregoing, it can be seen that prizes 60 cannot be taken from the game 10 without the key 90, a combination or other means which is controlled by the attendant or manager. Since the game will be adjusted because of the higher value so that the game will allow fewer prizes to be collected, then it will not be a significant disruption for the manager or attendant to have to open the game when there is a winner.

The above described embodiments are intended to be illustrative but not limiting to the scope of the present invention, the breadth of which is intended to be governed solely by the words of the appended claims. Those skilled in the art will readily envision various changes and alternate embodiments that fall within the scope of the present invention, and the claims are intended to include all such changes and alternate embodiments.

I claim:

1. A crane game comprising:

a pick-up device for picking up a prize from a collection of prizes;

a landing zone that the pick-up device places the prize upon acquisition of the prize, the landing zone including a floor that pivots from a horizontal position to a vertical position;

a projection that is extendable from inside the crane game to support the landing zone it the horizontal position, and retractable to allow the landing zone to pivot to the vertical position; and a collection compartment below the landing zone for transfer of the prize, the collection compartment accessible only using an unlocking means.

2. The crane game of claim 1, wherein the projection is movable by manually moving the projection against a biasing force to allow the floor of the landing zone to pivot.

3. The crane game of claim 1, wherein the projection is actuable from outside the crane game.

4. The crane game of claim 1, wherein the pick-up device is a vacuum.

5. The crane game of claim 1, wherein the pick-up device is a mechanical claw.

6. The crane game of claim 1, where the pick-up device is electro magnetic.

7. The crane game of claim 1, wherein the pick-up device is controlled by the player.

8. The crane game of claim 1, wherein the pick-up device is controlled by the crane game.

9. The crane game of claim 1, wherein the landing zone includes a layer of cushioning material to absorb a shock from releasing the prize by the pick-up device.

10. The crane game of claim 1, wherein the landing zone includes a layer of material to cushion the prize if lowered by the pick-up device.

* * * * *